US006064428A

United States Patent [19]

Trosino et al.

[11] Patent Number: 6,064,428

[45] Date of Patent: May 16, 2000

[54] AUTOMATED TRACK INSPECTION VEHICLE AND METHOD

[75] Inventors: Michael Trosino, Wyndmoor; John J. Cunningham, Coatesville; Alfred E. Shaw, III, Malvern, all of Pa.

[73] Assignee: National Railroad Passenger Corporation, Washington, D.C.

[21] Appl. No.: 08/691,189

[22] Filed: Aug. 5, 1996

[51] Int. Cl.[7] ..... H04N 7/18; H04N 9/47

[52] U.S. Cl. ..... 348/128; 348/148

[58] Field of Search ..... 348/125, 128, 348/130, 148; H04N 7/18, 9/47

[56] References Cited

U.S. PATENT DOCUMENTS

| | | | |
|---|---|---|---|
| 3,562,419 | 2/1971 | Stewart et al. . | |
| 3,896,665 | 7/1975 | Goel . | |
| 4,040,738 | 8/1977 | Wagner | 356/3.06 |
| 4,173,073 | 11/1979 | Fukazawa et al. | 33/338 |
| 4,288,855 | 9/1981 | Panetti | 702/168 |
| 4,468,966 | 9/1984 | Bradshaw . | |
| 4,700,223 | 10/1987 | Shoutaro et al. . | |
| 4,779,095 | 10/1988 | Guerreri . | |
| 4,899,296 | 2/1990 | Khattak . | |
| 4,915,504 | 4/1990 | Thurston | 356/376 |
| 5,075,772 | 12/1991 | Gebel . | |
| 5,212,655 | 5/1993 | Boehle . | |
| 5,410,346 | 4/1995 | Saneyoshi et al. . | |
| 5,429,329 | 7/1995 | Wallace et al. | 246/166 |
| 5,461,357 | 10/1995 | Yoshioka et al. . | |
| 5,721,685 | 2/1998 | Holland et al. | 701/207 |

*Primary Examiner*—Tommy P. Chin
*Assistant Examiner*—Nhon T Diep
*Attorney, Agent, or Firm*—Lowe Hauptman Gopstein Gilman & Berner

[57] ABSTRACT

An automated track inspection vehicle for inspecting track for anomalies includes a self-propelled car equipped with cameras for creating images of the track. A driver and inspector visually inspect the track and right-of-way through a window in the vehicle. Additionally, the images from the cameras are viewed by an inspector on a video terminal to detect anomalies. When anomalies are detected by the driver, inspector, or various redundant detection systems, a signal is provided to store the video data for later review by an analyst. The analyst will review the stored video data to confirm the presence of an anomaly and generate a track inspection report identifying at least the type and location of anomaly and the required remedial action.

42 Claims, 5 Drawing Sheets

AUTOMATED TRACK INSPECTION VEHICLE AND METHOD

TECHNICAL FIELD

This invention relates to the inspection of railroad tracks for anomalies, and more particularly, to an automated vehicle and method for inspecting railroad tracks.

BACKGROUND ART

The Federal Railroad Administration (FRA) requires periodic inspection of railways to ensure safety of track structures. The inspection requirements of railways are set forth in 49 CFR Part 213. In addition to other types of required inspections, such as the biannual inspection of tracks with ultrasonic and magnetic testers for internal defects, visual inspection of the tracks are required, as mandated by 49 CFR 213.233 (b):

> Each inspection must be made on foot or by riding over the track in a vehicle at a speed that allows the person making the inspection to visually inspect the track structure for compliance with this part. However, mechanical, electrical and other track inspection devices may be used to supplement visual inspection. If a vehicle is used for visual inspection, the speed of the vehicle may not be more than 5 miles per hour when passing over track crossings, highway crossings, or switches.

The frequency of such visual inspection varies with the class of the track. Each track is classified depending on, for instance, the type of use to which the track is subjected, i.e., freight, hazardous freight, passenger, etc.; the speed for which the track is rated; the number and weight of the cars typically travelling over the track; etc. The most rigorous inspection schedule is twice weekly with at least a one calendar day interval between inspections. 49 CFR 213.233 (c). Because a number of different rail usages trigger the most rigorous inspection schedule, most of the main line railroad in the United States is required to comply with twice weekly visual inspections.

The types of anomalies to be detected by visual inspection are set forth in Part 213 of 49 CFR and generally encompass anything that effects the structure or the ability of trains to operate on the track. A competent inspector will note such things as loose spikes, defective ties, weeds or other growth growing near the tracks, brush or other growth blocking signals, blockage in a drainage ditch, catenary wires hanging too low, or a weakness in the ballast. Additionally, track inspectors sometimes find a crack in a rail, either by seeing the crack or, if the inspector is operating a vehicle, by hearing an unusual noise indicating a problem with the rail structure.

Currently, visual inspection of track is accomplished in one of two methods. In the first method, an individual inspector walks a length of track, viewing the track for anomalies. Upon detecting an anomaly, the inspector notes the type of anomaly and an approximate location of the anomaly, and either takes remedial action to correct the defect or orders an appropriate remedial action. Typically, a walking inspector covers 5 miles of track each day, at a rate of approximately 1.5 miles per hour. Because the FRA requires the track to be inspected twice per week, not on consecutive days, a standard inspection schedule for a walking inspector involves covering a five-mile segment of track on Monday, covering a second five-mile segment of track on Tuesday, repeating the first five-mile segment on Wednesday, repeating the second five-mile segment on Thursday, with Friday scheduled as a free day, enabling the inspector to inspect track that was missed during the week, for whatever reason, or to complete whatever paperwork is required. Thus, the walking inspector covers ten miles of track per week.

In the second method, a vehicle is used to travel a length of track, with one or more inspectors viewing the track through a window. The vehicle is generally a truck adapted to ride on rails, more commonly called a high rail truck. As in the first method, upon detection of an anomaly, the inspector notes the type of anomaly, an approximate location of the anomaly, and either takes remedial action or recommends an appropriate remedial action. An inspection vehicle typically travels at speeds of approximately 10 miles per hour, and thus covers approximately 50–60 miles of track per day. Inspection by vehicle follows an inspection schedule similar to that of a walking inspector, covering one segment of track on Monday, a second segment on Tuesday, repeating the two segments on Wednesday and Thursday, respectively, with Friday as a scheduled free day.

In general, the vast majority of visual inspections are performed using a high rail truck. Unfortunately, in areas where there is a high traffic incidence, it is not feasible to tie up the track with a high rail truck during the day, and nighttime testing with the vehicle is difficult due to lighting constraints. Hence, walking inspection is required in such areas. With either method, the cost of visual inspection of track is very significant. The assignee of the present invention, the National Railroad Passenger Corporation (hereinafter "Amtrak"), estimates that the costs of complying with the requirement for visual inspections of all tracks carrying passenger trains to account for approximately thirteen percent of the annual track maintenance expense incurred on the Northeast Corridor.

Attempts have been made to automate one or more of the inspections required by the FRA; however, none of the automated methods address the visual inspection requirements set forth in 49 CFR 213.233.

An example of an automated inspection system is a gauge restraint measuring system (GRMS), developed by the FRA in conjunction with the Association of American Railroads (AAR). The GRMS provides an indication of the relative lateral strength of the track structure. The system measures the lateral distance between the tracks, puts the track under a load, measures the loaded lateral distance between the track, calculates the incremental change between the unloaded and loaded lateral distance measurements, and utilizes the calculated incremental change to produce an indication of the relative lateral strength of the track structure, thus enabling the prediction of potential failure of the ties.

Yet another example of automated inspection is a vehicle developed by the assignee of the present invention, Amtrak, to collect and analyze track geometry and ride quality data for passenger track. The vehicle was developed responsive to the conditions imposed by the FRA responsive to a request by Amtrak for a waiver to operate passenger trains in excess of 110 mph. Under the conditions of the waiver, Amtrak is permitted to operate trains at speeds greater than 110 mph, provided a track geometry inspection car is operated on all affected track on a monthly basis. The vehicle is equipped with a track geometry measuring system (TGMS) which measures a number of geometrical components of the railroad track, such as the distance between the two rails (i.e., the track gage), the relative levelness of the rails to each other, the relative straightness of the two rails with respect to vertical and horizontal planes, and the shape of the curves of the track. The TGMS utilized by Amtrak is an inertial system, i.e., the system sets up an inertial reference frame to which the rail is compared. A measurement of track is taken approximately every foot, and differences exceeding a predetermined measurement are flagged, those differences affecting the safe and comfortable operation of the train over the track.

In addition to these automated inspection systems, pattern recognition systems are beginning to be utilized in railroad applications. One example is a rail profile measuring system, in which a video camera is utilized to view the rail and measure the shape of the rail. The images are returned to a computer to identify defects in or excessive wear of the rail. Additionally, the system employs a pattern recognition algorithm to compare the image of the rail to a preselected database of rail shape to identify the particular type of rail measured.

Unfortunately, none of these automated inspection vehicles fulfill the requirements of the FRA for visual inspection of track, set forth in 49 CFR 213.233; nor are they useful in reducing the costs associated with compliance with the visual inspection requirements.

Accordingly, it is one object of the invention to provide an improved inspection vehicle for visual inspection of railroad tracks.

Another object of the invention is to provide an improved inspection vehicle and method of inspection which reduce the high costs currently associated with visual inspection.

Yet another object of the invention is to provide an improved inspection vehicle and method of inspection which permits travel over railroad tracks at speeds in excess of 25 mph.

A further object of the invention is to provide an improved inspection vehicle and method of inspection providing a redundant/backup means for ascertaining defects.

DISCLOSURE OF THE INVENTION

These and other objects of the invention are achieved by the automated track inspection vehicle and method of inspection of the present invention.

According to the present invention, a vehicle is provided for automatically inspecting railroad track to detect an anomaly. The vehicle comprises a car or high-rail truck, preferably self-propelled, for travel on a railroad track and an inspection system. The inspection system further comprises a vision system including a camera mounted on the car for creating an image of the track including the anomaly and a video system. The image is viewed on the video system to detect the anomaly.

Additionally, the inspection system may further comprise a window through which the track may be viewed to detect the anomaly. Preferably, a video storage system is provided for storing the image generated from the vision system. The video storage system may be a video tape recorder. Alternatively, the video storage system may store the image in a digital format. The video storage system may also store data representing the plurality of geometry parameters generated by a measuring system.

It is also preferred that one or more cameras be mounted on a forward end of the car to create a right-of-way image of the track. A light is disposed in the vicinity of the cameras to illuminate the track.

The vision system may include multiple cameras mounted on the car to simultaneously view the track from a plurality of viewpoints, with one or more of the multiple cameras located at the front of the vehicle to create a right-of-way image. Further, the plurality of viewpoints may include a plan view gage side and a field side of each rail of the track.

According to a preferred embodiment, at least one of the multiple cameras is located beneath the vehicle with a lens pointing down at the track to create a plan view image of the track.

According to one aspect of the present invention, the car includes a pair of driver operating stations, preferably identical, at each end of the car, wherein the car can be operated in either direction from either station.

According to another aspect, the vehicle includes a display terminal for the track image.

According to yet another aspect, the vehicle includes a measuring system for automatically measuring a plurality of geometry parameters of the track. Preferably, the measuring system includes a processing system for comparing the measured geometry parameters to predetermined geometry parameters to detect the anomaly. Also preferably, the measuring system measures distance travelled by the car and provides a distance marker representing distance travelled, and the vehicle further comprises an interface between the measuring system and the vision system for including the distance marker in the image.

Also preferably provided is a means for signalling to the vision system upon detecting the anomaly, and a storage means for storing the image including the detected anomaly.

According to another aspect of the present invention, the vision system includes a pattern recognition system operatively connected to the vision system, the pattern recognition system including a predetermined expected pattern for the image of the track and a means for ascertaining variations in the image from the predetermined expected pattern. The pattern recognition system may further include a means for determining whether the ascertained variations in the image form the anomaly and a means for signalling the detection of the anomaly.

According to yet another aspect, the vehicle includes a means for signalling to the vision system upon detecting the anomaly and a storage means for storing the image including the detected anomaly.

According to another embodiment of the present invention, a vehicle for automatically inspecting railroad track to detect an anomaly comprises a car, preferably self-propelled, for travel on a railroad track and an inspection system to detect the anomaly. The inspection system comprises a vision system including a camera mounted on the car to create an image of the track including the anomaly and a video storage system for recording the image including the anomaly.

As in the first embodiment, a video system permits viewing of the recorded image to detect the anomaly, and the inspection system includes a window through which the track may be viewed to detect the anomaly.

Also as in the first embodiment, the vehicle includes a measuring system for automatically measuring a plurality of geometry parameters of the track and a processing system for comparing the measured geometry parameters to predetermined geometry parameters to detect the anomaly. Preferably, the measuring system measures distance travelled by the car and provides a distance marker representing distance travelled, with the vehicle further comprising an interface between the measuring system and the vision system for including the distance marker in the image.

A pattern recognition system may be provided, operatively connected to the vision system, and including a predetermined expected pattern for the image of the track, a means for ascertaining variations in the image from the predetermined expected pattern, and a means for determining whether the ascertained variations in the image form the anomaly.

In yet another preferred embodiment, a vehicle for automatically inspecting railroad track to detect anomalies comprises a car, preferably self-propelled, for travel on a railroad track and a combination manual and automatic inspection system to detect the anomalies. The inspection system comprises a window through which the track may be viewed, and a vision system including a camera mounted on the car for creating images of the track and a video system for displaying the images of the track.

According to an aspect of this embodiment, a measuring system is provided for automatically measuring a plurality of geometry parameters on the track and detecting anomalies in one or more of the plurality of parameters.

The present invention is also directed to a method of detecting an anomaly in a railroad track. A car is guided along railroad track, and the track is viewed through a window in the car to detect the anomaly. An image of the track is created through a camera located on the car and viewed through a display terminal located inside the car to detect the anomaly. Upon detection of the anomaly, a signal is provided representative of the detection of the anomaly, and upon receipt of the signal, the image of the track including the anomaly is recorded.

Preferably, if an anomaly is detected through the window, a signal representative of the detection of the anomaly is provided, and the recording of the image occurs upon receipt of either signal.

Preferably, upon receipt of the signal, the recorded image is viewed to confirm or deny the anomaly. After confirming the anomaly, the method includes generating a report of the anomaly.

Preferably, the step of generating a report includes evaluating the anomaly and including the evaluation in the generated report, and determining recommendations for remedial action to be taken for the anomaly and including the recommendations in the generated report. Also preferably, the image of the anomaly and the generated report are archived.

According to one aspect, the step of creating an image of the track includes creating multiple images of the track through multiple cameras at various locations on the car.

According to another aspect, the method includes the step of measuring the distance travelled by the car along the track and providing a distance marker, wherein the step of recording the image of the track including the anomaly includes noting the distance marker at which the anomaly was detected.

According to yet another aspect, the method includes the steps of measuring the distance travelled by the car along the track, and providing with the image of the track a distance marker representing a distance measurement, wherein the steps of viewing and recording the image includes viewing and recording the distance marker.

According to a further aspect, the method further includes the steps of measuring a plurality of geometry parameters on the track, including distance and calculating the anomaly from one or more of the plurality of parameters.

Preferably, the step of creating an image of the track includes creating plan view images of the track, and the method further comprising the steps of determining an expected pattern for the image of the track and employing a pattern recognition algorithm to ascertain variations between the image and the expected pattern.

According to another embodiment, a method of detecting an anomaly in a railroad track comprises the steps of guiding a car along railroad track; creating an image of the railroad track through a camera located on the car; recording the image of the track; and viewing the recorded image to detect the anomaly.

In another embodiment, a method of detecting an anomaly in a railroad track comprises the steps of guiding a car along railroad track; creating an image of the track through a camera located on the car; viewing the image of the track through a display terminal located inside the car to detect the anomaly; upon detection of the anomaly, recording the image of the track.

In yet another embodiment, a method of detecting the anomaly in a railroad track comprises the steps of guiding a car along railroad track; viewing the track through a window in the car to detect the anomaly; creating an image of the track through a camera located on the car; viewing the image of the track through a display terminal located inside the car to detect the anomaly; measuring a plurality of geometry parameters on the track, including distance; detecting the anomaly by calculating variations between one or more of the plurality of measured parameters and a plurality of expected parameters; upon detection of the anomaly, providing a signal representative of the detection of the anomaly; and upon receipt of the signal, recording the image of the track including the anomaly.

A further embodiment provides a method of detecting an anomaly in a railroad track comprising the steps of creating an image of the track through a camera; determining an expected pattern for the image of the track; and ascertaining variations between the image from the predetermined expected pattern. Preferably, the method further includes determining whether the ascertained variations in the image form the anomaly.

According to another embodiment, a method of detecting an anomaly in a railroad track comprises the steps of creating an image of the track through a camera; and viewing the image of the track through a display terminal to detect the anomaly.

Yet another embodiment provides a method of detecting an anomaly in a railroad track comprising the steps of creating an image of the track through a camera; recording the image of the track; and viewing the recorded image through a display terminal to detect the anomaly.

BEST MODE FOR CARRYING OUT THE INVENTION

Figure 1:
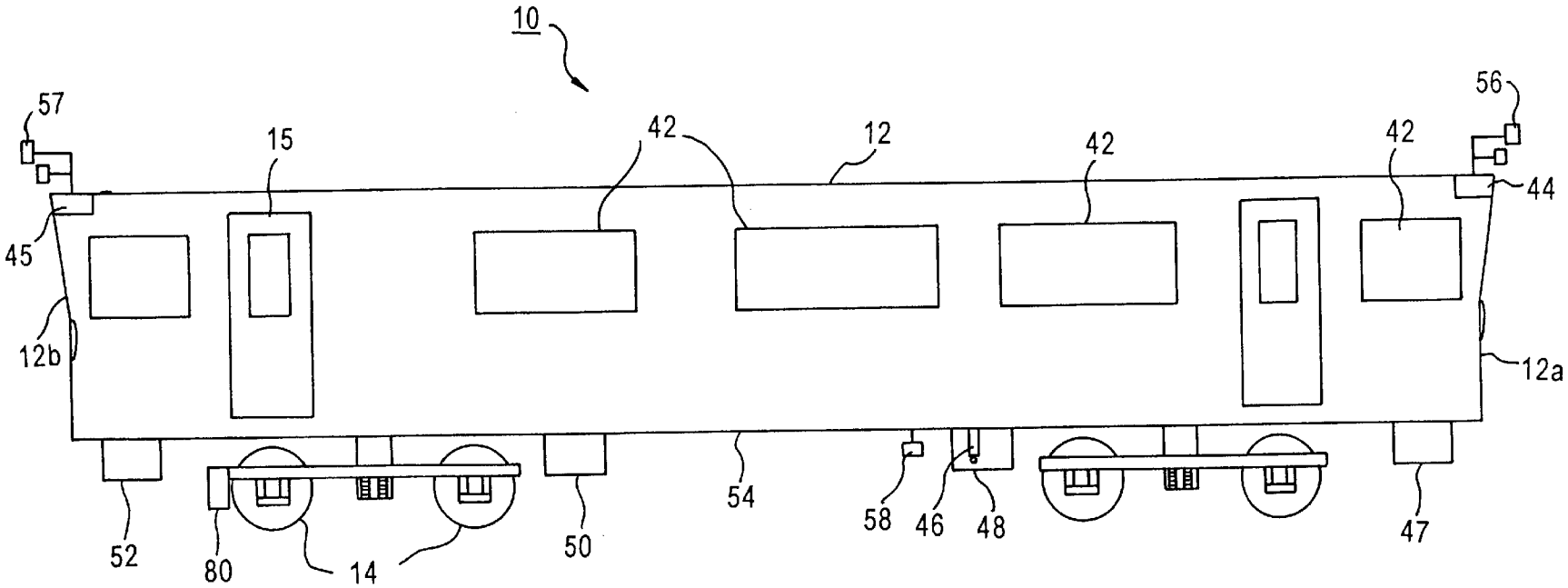
FIG. 1 is a side view of the vehicle of the present invention.
Figure 2:
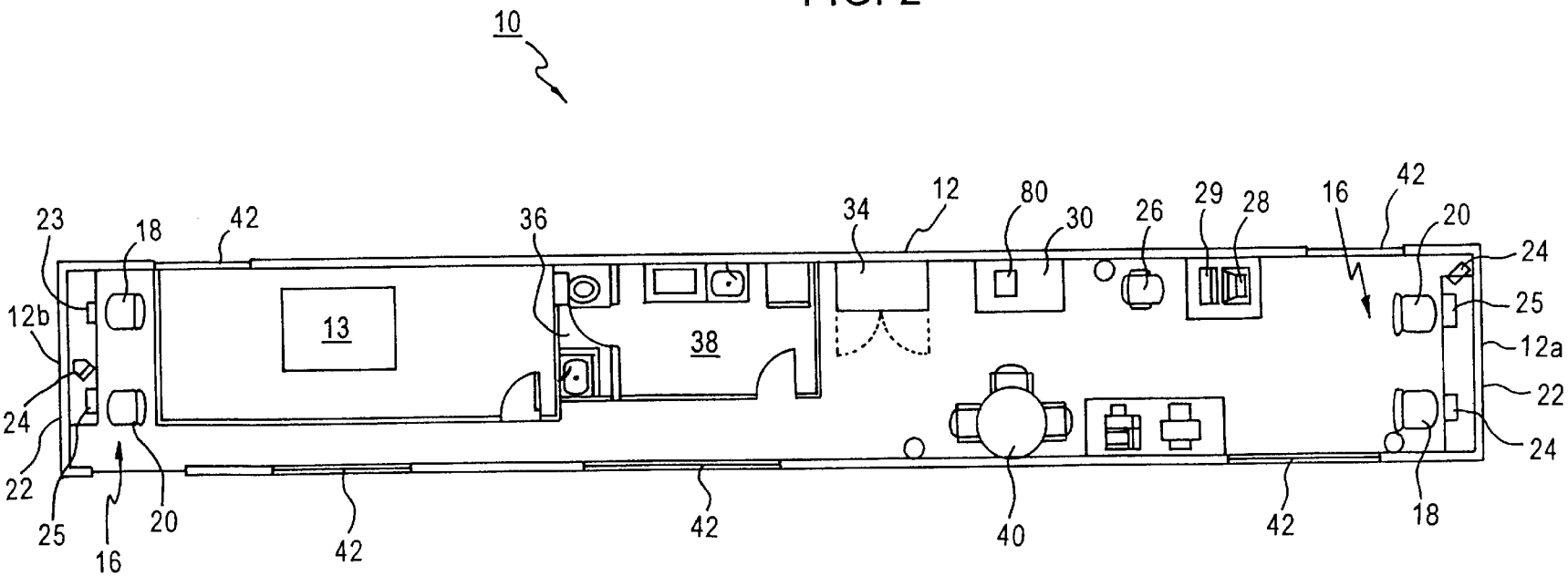
FIG. 2 is a cross-sectional view taken along line 2—2 of FIG. 1.
Figure 3:
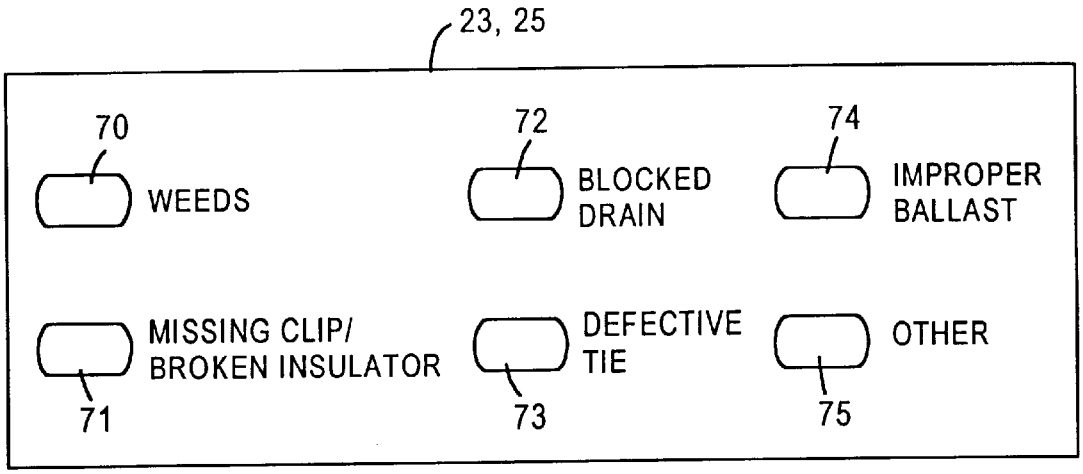
FIG. 3 is a schematic depiction of a keyboard for use by the driver and/or inspector.

FIGS. 1–3 constitute an illustration of one embodiment of the automated track inspection vehicle 10 according to the present invention. As will be described in more detail below, the vehicle 10 permits visual inspection of the track at speeds of 30–50 mph or faster. To achieve effective visual inspection at these speeds, a vision system 60 permits an image of the track to be captured, recorded, manipulated and reviewed to detect and identify anomalies. Additionally, the vehicle advantageously permits the installation of redundant anomaly detection system, such as the track geometry measuring system 80, similar to that previously described.

The automated track inspection vehicle 10 is designed to be operated by three individuals in the capacity of a driver, an inspector and an analyst. Each of the three individuals will be trained for all three positions so that they can rotate responsibilities over the course of the shift. Generally, the driver is responsible for operating the vehicle. While operating the vehicle, the driver, looking at the track through a window, may visually detect the presence of an anomaly, in which case the driver provides a signal, resulting in the recording of the captured image of the track for later review by the analyst. The inspector's sole function is to detect anomalies. The inspector sits beside the driver and views the track through the window. Like the driver, the inspector may provide a signal upon detection of an anomaly through the window. Furthermore, the inspector views the real time video images of the track through a terminal. Again, if the inspector identifies an anomaly through the terminal, a signal is provided and the video including the anomaly is stored for later review by the analyst. The analyst does not review the real time images of the track; rather, the recorded images of the track are queued in the computer system for the analyst to review. The analyst will review the recorded image to either confirm the presence of an anomaly or determine that no anomaly exists. In the event that it is determined that the video does not include an anomaly, the video is discarded upon the analyst's instruction. If the anomaly is confirmed, the analyst will enter an evaluation of the anomaly, including the type and location of each anomaly, and recommendations for remedial action to be taken. This data, along with the video of the anomaly, will be entered into a report generated at the end of the shift.

Referring in more detail to FIGS. 1 and 2, vehicle 10 includes a car 12. Preferably, car 12 is self-propelled by an engine 13, preferably diesel powered, in which case car 12 may be any suitable self-propelled car adapted to travel along railroad tracks. Optionally, car 12 can be pulled by an engine in a conventional manner. Preferably, car 12 can travel at speeds up to 60 miles per hour, although an operation speed in the range of 30 to 50 miles per hour is anticipated. As depicted in FIG. 1, car 12 includes railroad wheels 14 and at least one door 15 for entry and exit.

Referring to FIG. 2, a pair of driver stations 16 are provided at both ends 12*a*, 12*b* of self-propelled car 12, advantageously permitting the vehicle to be operated in either direction, thereby eliminating the necessity to reverse the car on the tracks in order to change the direction of travel. Each pair of driver stations 16 includes a driver seat 18 and an inspector seat 20. Both driver and inspector seats 18, 20, are positioned such that both a driver and an inspector can view the track through windows 22 at both ends 12*a*, 12*b*. Furthermore, the driver seat 18 includes a keyboard 23 positioned between the driver and the window. Additionally, situated in the vicinity of inspector seat 20 is an inspector terminal 24 with keyboard 25.

An analyst work station 26, situated preferably in the interior of the car 12, includes a terminal 28 with a keyboard 29. Preferably, analyst work station 26 is adjacent to a rack 30 holding such computer components as a printer, local area networking devices, hard drives, etc., and a storage/media cabinet 34.

To enhance the working conditions for the driver, inspector and analyst, car 12 includes a bathroom 36, a kitchen 38, and a table and chairs 40. Additionally, windows 42 are provided to improve the lighting conditions inside the car.

Referring to the exterior of the car illustrated in FIG. 1, a number of cameras are disposed on the exterior of the car. Specifically, front and rear right of way cameras 44, 45, are provided at ends 12*a*, 12*b*, respectively. A plurality of cameras 44, 45 may be included at each end as required to create complete three-dimensional images of the right of way. These cameras create a continuous three-dimensional image of the railroad track, including the rail, crossties and clips, the ballast, the catenary, and the brush on the sides of the tracks. Additionally, a number of road bed cameras 45 are disposed along the underside 54 of car 12 normal to the track such that the lens of the cameras point downwardly, viewing the track from above. More specifically, road bed cameras 46 are disposed crosswise along underside 54, at one or more locations 47, 48, 50, 52. Road bed cameras 46 together create a plan view of both rails and eliminate blind spots. These cameras must provide sufficient resolution and shutter speed to allow stop action viewing of images on a frame by frame basis without blurring as the vehicle travels at variable speeds ranging from 0 to 50 miles per hour.

Preferably, cameras 46 are spaced at various crosswise locations along the track. For example, one possible configuration might be with one camera 46 placed at the field side (i.e., viewing the track components and side of the rail located outside of the two rails) of the right rail (when facing front 12*a* of car 12), a second camera 46 placed at the gage side (i.e., viewing the track components and side of the rail located between the two rails) of the right rail, a third camera 45 placed at the gage side of the left rail, and a fourth camera 46 placed at the field side of the left rail. It thus can be appreciated that as self-propelled car 12 travels along the railroad track, the cameras 44, 45 create a perspective view image of the right of way of the track and cameras 45 create close-up plan view images of the right and left rails. Advantageously, car 12 also includes right of way lights 56, 57 adjacent to the right of way cameras 44, 45, respectively, and road-bed lights 58 adjacent cameras 46 to provide illumination of the track. Preferably, lights 56, 57, 58 are shielded to avoid blinding other train operators.

Figure 4:
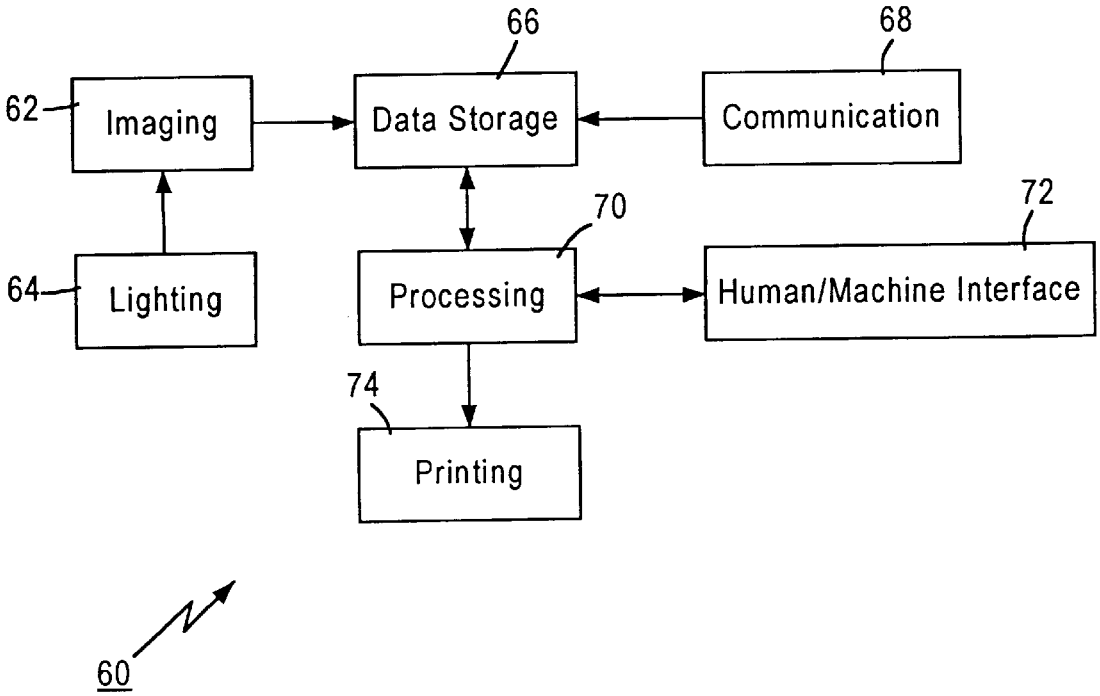
FIG. 4 is a schematic representation of the relationship between the components of the vision system.

A vision system 60 creates, captures, stores and manipulates the images of the track. FIG. 4 schematically depicts the components of vision system 60. Cameras 44, 45, and 46 constitute the imaging system 62, which as previously stated, obtains video images of the gage side, field side, and right-of-way of the track during an inspection trip. Imaging system 62 produces digital imagery of sufficient quality and resolution such that camera viewing angle, focal lengths, and pixel resolutions are of sufficient quality to permit the use of pattern recognition algorithms, as described below. The lighting system 64, specifically, lights 56, 57, provides the necessary illumination to the imaging system 62 to allow it to function properly.

Vision system 60 includes a data storage system 66 utilized for the storage of all data contained within the vision system. This data includes data received from the track geometry measuring system 80 necessary for the analyst, digitized video images of suspected and verified track anomalies, and a chronology of the inspection trip.

A processing system 70 provides the computational capabilities required for the vision system 60. Processing system 70 allows digitized data to be displayed on the inspector and analyst terminals 24, 28, supports the preparation of the Track Inspection report, and coordinates data exchanges within the vision system 60.

Communication system 68 supplies the necessary hardware to interconnect the track geometry measuring system 80 to the vision system 60. Data from the track geometry measuring system 80 is passed to the vision system 60 across communication system 68.

An interface 72, providing interface between the driver, inspector and analyst and the vision system 60 and other testing systems in use on the car (i.e., TGMS), includes inspector and analyst terminals 24, 28 and driver, inspector and analyst keyboards 23, 25 and 29. At inspector terminal 24, the inspector receives a video image of the gage, field, and right-of-way of the track to assist in anomaly detection. Detection of an anomaly is presented to the vision system via the driver or inspector keyboard 23, 25. Data of suspected track anomalies will be presented visually to the analyst for examination and evaluation via the analyst terminal 28. Analyst keyboard 29 provides a means of preparing the Track Inspection Report generated as a result of the inspection trip.

A printing system 74 is provided to output the Track Inspection report after a completed trip.

Preferably, data storage system 66 permits various information, such as the type of anomaly as indicated by the pushbutton depressed by the driver or inspector, the date and time the anomaly was detected, a milepost location, the source of detection, and the review status, to be attached to the digital imagery produced by imaging system 62.

Both driver keyboard 23 and inspector keyboard 25 preferably include a selection of six programmable pushbuttons, as schematically depicted in FIG. 3. Each of the six control buttons shall identify a specific type of anomaly to the vision system 60. For instance, for illustration only, pushbutton 70 may indicate weeds or other growth in or near the tracks; pushbutton 71 may indicate a missing clip or a broken insulator; pushbutton 72 may indicate a defective tie; pushbutton 73 blockage in a drainage ditch; pushbutton 74 a ballast problem; and pushbutton 75 any other anomalies not otherwise classified. Either or both of the driver and inspector, upon detection of the anomaly, will indicate a preliminary determination of the anomaly by choosing the appropriate pushbutton.

Preferably, the analyst's terminal is password protected, and the vision system will not permit the analyst to logoff the system until all suspected anomalies have been reviewed and report entries made. The terminal further preferably includes various image processing functions to permit the analyst to fully view and analyze the identified anomaly. For instance, it is desirable that the analyst can manipulate the image to roam, that is, display portions of the image when the image is larger than the screen size. Additionally, the analyst may want to zoom in on the image by magnifying a selected portion of an image or to view more portions of an image at a reduced resolution. Preferably, the zoom function utilizes pixel interpolation, as is known in the art. It is also desirable to provide the ability to manipulate the image by panning, that is, moving the image viewing area around the image when the image is too large for the screen. Further, it is advantageous to the generation of the report that the analyst be able to annotate and overlay the image with graphics and/or text.

Vision system 60 will maintain archival records of each entire inspection trip. These records will include at least the following: a video tape generated by the video output of the right of way camera(s); digitized images of each confirmed anomaly; support data such as location and type of anomaly received from the track geometry measuring system 80 for each anomaly; evaluation of each anomaly; annotation of evaluated valid anomalies for inclusion in the Track Inspection report; and a final copy of the Track Inspection report.

In addition to the detection of anomalies by the driver and the inspector as described, vehicle 10 includes additional redundant systems to facilitate the detection of anomalies. Specifically, the track geometry measuring system 80 (TGMS) is utilized to provide a distance measurement or milepost location for the right-of-way video images and for the detected anomalies. Additionally, the TGMS will identify exceptions to predetermined track geometry thresholds. Upon identification of such exceptions, the TGMS will signal to the vision system 60, which will respond by recording the plan view images including the exception to be reviewed by the analyst.

The TGMS and the vision system 60 will interface with each other so that milepost location, anomaly triggering and additional signal channels can be recorded and displayed with the video information. For instance, upon milepost detection, the TGMS may pass an ASCII text string or TTL (teletype language) pulse identifying the milepost information to the vision system over a computer interface.

To support the vehicle's operation by either driver station, the TGMS must be capable of measuring when the vehicle is traveling in either the forward or reverse direction without adjustment or recalibration. The TGMS may either directly measure the track geometry parameters or provide raw transducer signals to a processing system for calculation of these parameters as the vehicle moves along the track. Other preferred features of the processing system of the TGMS include control of a graphic display system, preferably through the vision system monitor 24 used by the inspector; recordation of all data collected by the TGMS for later retrieval and analysis in a playback mode; identification of exceptions to the predetermined track geometry thresholds and communication in real-time of the presence of exceptions forming anomalies; providing printed reports for the track which has been measured; and monitoring of the status of the measuring instruments and related devices and displaying warning messages in the event of malfunction. Advantageously, the graphic display system will display the last milepost passed and the distance from the last milepost, the current track number, the posted class of track and posted track speed, the operating speed of the vehicle, any exceptions to the posted class of track, and messages indicating the status of the various components of the TGMS.

Another redundant system provided by the vehicle 10 is the use of a pattern recognition algorithm utilizing the plan view images created by cameras 46. Although such an algorithm is generally known in the art, application of pattern recognition to visual inspection of railroad tracks is unique. The pattern recognition algorithm is particularly useful in detecting such anomalies as missing clips, items disposed on the track, etc.

Other systems that may be installed on the automated track inspection vehicle 10 include global positioning systems for time stamping and geolocation; state-of-the-art image sensor technology including stereography; and the GRMS previously described.

Figure 5:
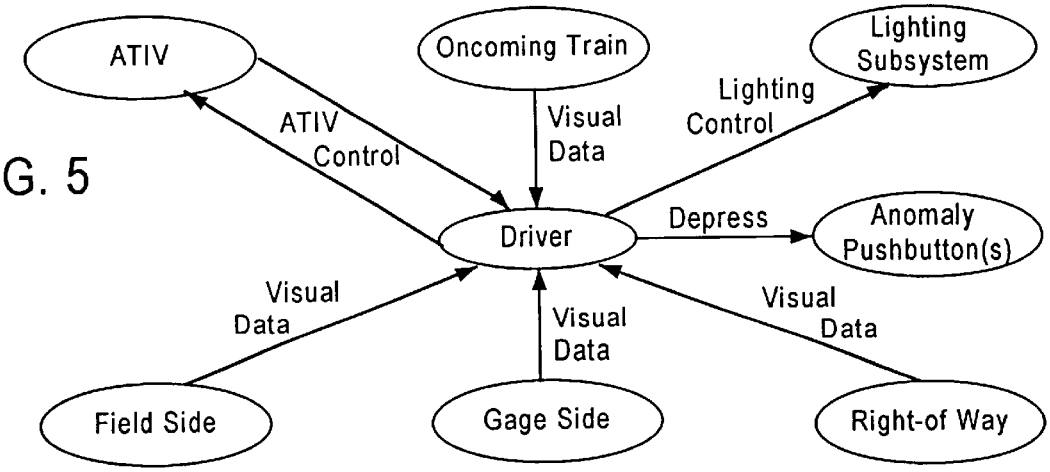
FIG. 5 is a schematic representation of the flow of information to and from the driver.
Figure 6:
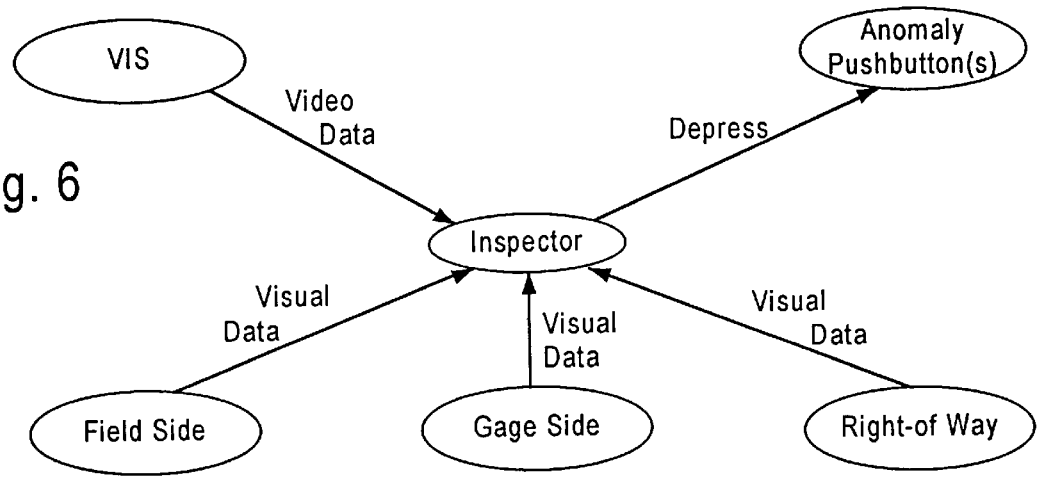
FIG. 6 is a schematic representation of the flow of information to and from the inspector.
Figure 7:
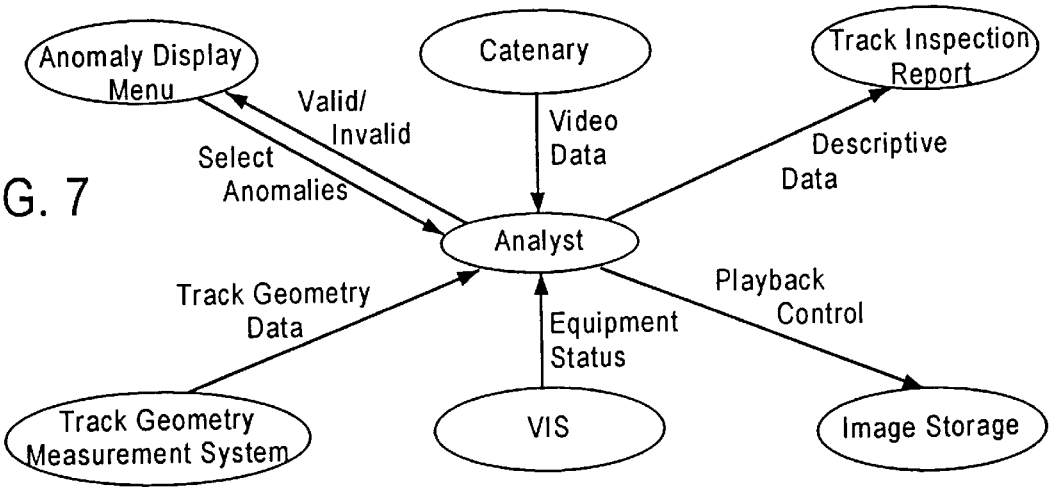
FIG. 7 is a schematic representation of the flow of information to and from the analyst.

FIGS. 5–7 schematically represent the flow of information to the various members of the crew. Referring to FIG. 5, the driver is primarily responsible for operating the vehicle. The driver also operates the lighting subsystem, dimming the lighting, if necessary, to oncoming trains. While operating the vehicle, the driver will also scan the track right-of-way and the field and gage sides of the track through the window of the vehicle for anomalies, and indicate the detection of anomalies by depressing one or more anomaly pushbuttons.

The inspector's primary responsibility, as represented in FIG. 6, is the detection of track anomalies. Like the driver, the inspector receives visual data of the track right-of-way and the field and gage sides of the track through the window of the vehicle. The inspector further receives the video image of the track right-of-way, captured by one of cameras 44, 45, from the vision system 60. The inspector indicates the detection of anomalies by depressing one or more anomaly pushbuttons.

The analyst's responsibilities are represented in FIG. 7. It is the analyst's primary responsibility to verify track anomalies and detect catenary anomalies. The analyst receives real-time video data of the catenary from the right-of-way cameras, equipment status information from the vision system 60, and track geometry data from the track geometry measurement system. Additionally, when analyzing suspected track anomalies, the analyst will be presented with an anomaly display which lists all suspected track anomalies detected on the inspection trip. The display will indicate the evaluation status of each track anomaly and allow for display of the image of the anomaly. If the track anomaly has been evaluated, the display will indicate the disposition of the suspected track anomaly. Upon selecting a track anomaly to view, the analyst will be presented with a digitized image of the track area, both before, during and after the suspected anomaly. The analyst will have the capability of replaying this image at various playback rates to include, but not be limited to, real-time and step-frame. If the track anomaly is confirmed, the analyst will indicate this fact on the anomaly display and enter descriptive information about the anomaly into the vision system to be utilized in the Track Inspection report. Preferably, a list of the most common track anomalies and their respective Track Inspection report entries will be presented to the analyst for selection and inclusion. In addition, a free-format field for miscellaneous comment input is supplied. This process advantageously minimizes operator input and facilitates easy movement between various displays or windows. If the track anomaly is determined to be invalid, the analyst will indicate this fact on the anomaly display. All suspected track anomalies will be retained in the system, regardless of having been evaluated as confirmed or invalid.

Figure 8:
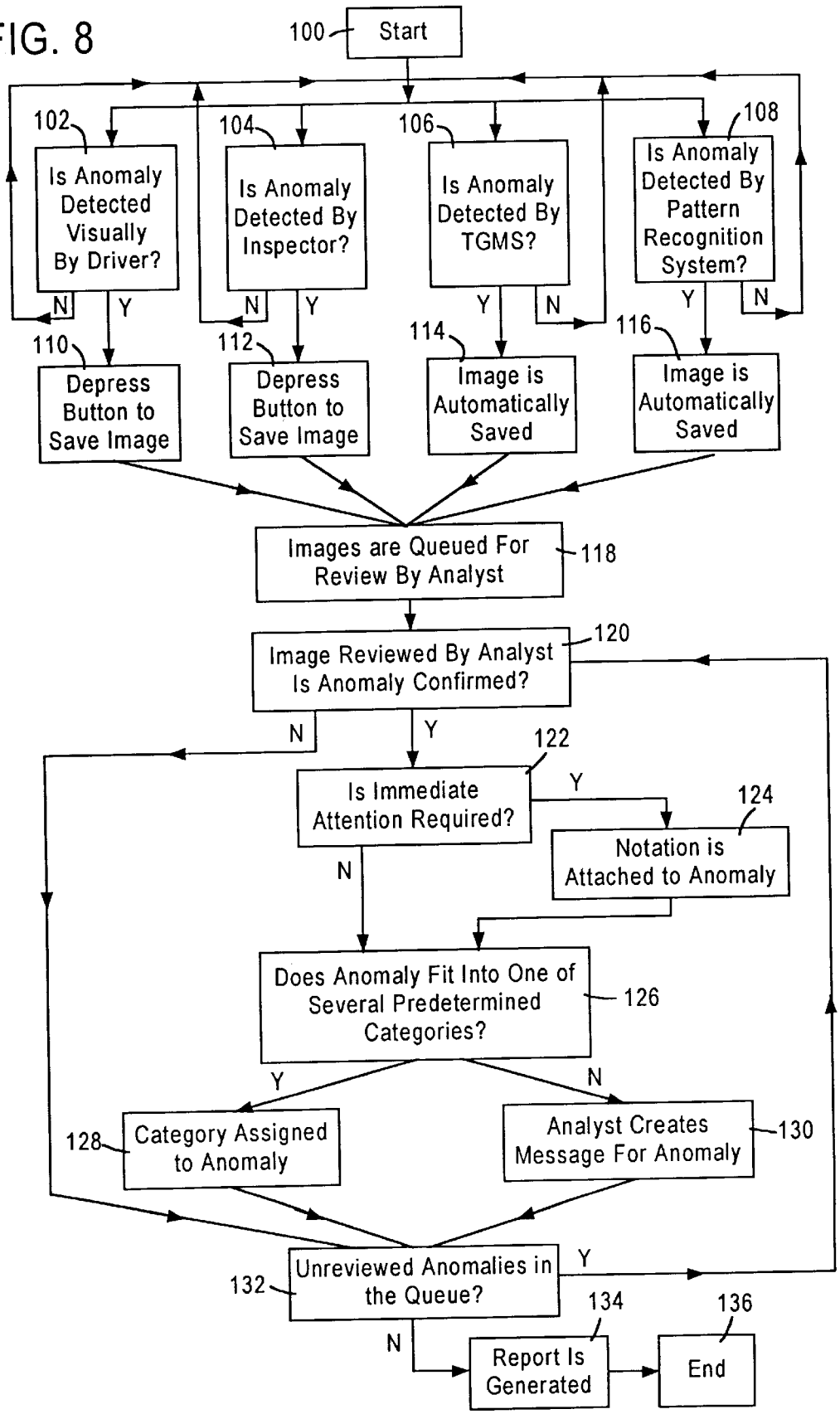
FIG. 8 is a flow chart showing the flow of information among the various components of the vehicle of the of the present invention.

The flow of information among the various components of the automated track inspection vehicle 10 is schematically represented in flow chart format in FIG. 8. At step 100, the process begins, and proceeds to steps 102, 104, 106 and 108 for anomaly detection. In step 102, the driver has the opportunity to visually detect an anomaly through the vehicle window. If an anomaly is detected, a button is depressed at step 110 to save the track image including the anomaly. A minimum amount of track coverage is stored, preferably at least 256 feet of track so as to ensure the inclusion of a milepost indicator from the TGMS 80. Similarly, at step 104, an anomaly may be detected by the inspector, either through the window or via the video system. If the inspector detects an anomaly, step 112 requires the depression of a button to save the image of the track including the anomaly, again, preferably a minimum of 256 feet of track coverage.

In step 106, an anomaly may be detected by the TGMS, in which case the image including the anomaly is saved in step 114. Similarly, an anomaly may be detected by the pattern recognition system at step 108 and the image including the anomaly saved in step 116.

In step 118, all the images including anomalies stored in steps 110, 112, 114 and 116 are queued for review by the analyst. In step 120, the inspector reviews the image to determine if the image includes an anomaly. If the image does not include an anomaly, processing continues to step 132, wherein it is determined whether the queue contains unreviewed anomalies.

In step 120, if the anomaly is confirmed, the analyst is then asked, in step 122, whether immediate attention is required. If so, a notation is attached to the anomaly in step 124. In either event, processing progresses to step 126, wherein it is determined whether the anomaly fits into one of several predetermined categories. If so, the relevant category is assigned to the anomaly in step 128. If not, at step 130 the analyst creates a message for the anomaly. Processing progresses from either step 126, 128 or 120 to step 132 to determine whether there are unreviewed anomalies in the queue. If so, the process returns to step 120 for review of the next queued anomaly. Once it is determined in step 132 that all anomalies have been reviewed, a Track Inspection report is generated in step 134, and the processing ends at step 136 at the termination of the inspection trip.

With the foregoing arrangement, it can be seen that the vehicle of the present invention permits inspection of railroad track at a minimum speed of 30 miles per hour. The provision of the vision system, including the creation of video images of the track, storage of the images including anomalies, and manipulation of the stored images to adequately view the anomaly, permits inspection of the track at speeds greater than previously achieved in this type of inspection. The use of pattern recognition technology for this type of track inspection advantageously and uniquely provides automated inspection for various types of predictable track anomalies.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A vehicle for automatically inspecting railroad track to detect an anomaly, comprising:

a car for travel on a railroad track; and an inspection system comprising a computer enhanced vision system including a camera system having a plurality of cameras arranged beneath the vehicle to create a series of overlapping fields of view that cover the entire track structure by including oblique views, said computer enhanced vision system further including imaging software receiving inputs from said cameras representative of said overlapping fields of view for creating a continuous viewable complete three dimensional image simultaneously of (1) both rails of the track including (2) an entire lateral extent of cross ties extending both between the rails and outward of both rails, (3) rail fastening elements, and (4) ballast materials and (5) at least one anomaly in (1) through (4) if present; and a video system, wherein the image is viewable on the video system to detect the anomaly.

2. The vehicle of claim 1, wherein the car is self-propelled.

3. The vehicle of claim 1, wherein the inspection system further comprises a window through which the track is vieweable to detect the anomaly.

4. The vehicle of claim 1, the inspection system further comprising a video storage system for storing the image generated from the vision system.

5. The vehicle of claim 4, wherein the video storage system includes at least one of a video tape recorder or a digital recorder.

6. The vehicle of claim 4, wherein the video storage system further stores data representing the plurality of geometry parameters generated by a measuring system.

7. The vehicle of claim 4, wherein the image is stored in digital format.

8. The vehicle of claim 1, wherein the camera is mounted on a forward end of the car to create a right-of-way image of the track.

9. The vehicle of claim 8, further comprising a light disposed in the vicinity of the camera to illuminate the track.

10. The vehicle of claim 1, wherein at least one of the multiple cameras is located at the front of the vehicle to create a right-of-way image.

11. The vehicle of claim 1, wherein the plurality of viewpoints include a plan view gage side and a field side of each rail of the track.

12. The vehicle of claim 1, wherein at least one of the multiple cameras is located beneath the vehicle with a lens pointing down at the track to create a plan view image of the track.

13. The vehicle of claim 1, wherein the car includes a pair of driver operating stations at each end of the car, wherein the car can be operated in either direction from either station.

14. The vehicle of claim 13, wherein the pair of driver operating stations are identical.

15. The vehicle of claim 1, further comprising a light illuminating the track.

16. The vehicle of claim 1, further comprising a display terminal for the track image.

17. The vehicle of claim 1, further comprising a plurality of display terminals for the track image.

18. The vehicle of claim 1, further comprising a measuring system for automatically measuring a plurality of geometry parameters of the track.

19. The vehicle of claim 18, wherein the measuring system includes a processing system for comparing at least one of the plurality of the measured geometry parameters to at least one predetermined geometry parameters to detect the anomaly.

20. The vehicle of claim 18, wherein the measuring system measures distance travelled by the car and provides a distance marker representing distance travelled, the vehicle further comprising an interface between the measuring system and the vision system for including the distance marker in the image.

21. The vehicle of claim 1, further comprising a means for signalling to the vision system upon detecting the anomaly, and a storage means for storing the image including the detected anomaly.

22. The vehicle of claim 1, wherein the vision system further includes a pattern recognition system operatively connected to the vision system, the pattern recognition system including a predetermined expected pattern for the image of the track and a means for ascertaining variations in the image from the predetermined expected pattern.

23. The vehicle of claim 22, wherein the pattern recognition system further includes a means for determining whether the ascertained variations in the image form the anomaly.

24. The vehicle of claim 22, wherein the pattern recognition system further includes means for signalling the detection of the anomaly.

25. The vehicle of claim 22, further comprising a means for signalling to the vision system upon detecting the anomaly, and a storage means for storing the image including the detected anomaly.

26. A vehicle for automatically inspecting railroad track to detect an anomaly, comprising:

a car for travel on a railroad track; and an inspection system to detect the anomaly, the inspection system comprising a computer enhanced vision system including a camera system having a plurality of cameras arranged beneath the vehicle to create a series of overlapping fields of view that cover the entire track structure by including oblique views, said computer enhanced vision system further including imaging software receiving inputs from said cameras representative of said overlapping fields of view to create a continuous viewable complete three dimensional image simultaneously of (1) both rails of the track including (2) an entire lateral extent of cross ties extending both between the rails and outward of both rails, (3) rail fastening elements, and (4) ballast materials and (5) at least one anomaly in (1) through (4) if present; and a video storage system for recording the image including the anomaly.

27. The vehicle of claim 26, wherein the car is self-propelled.

28. The vehicle of claim 26, wherein the vision system includes a monitor on which the recorded image is viewed to detect the anomaly.

29. The vehicle of claim 26, wherein the inspection system further comprises a window through which the track is viewable to detect the anomaly.

30. The vehicle of claim 26, wherein one of the multiple cameras is located at the front of the vehicle to create a right-of-way image.

31. The vehicle of claim 30, further comprising a light disposed in the vicinity of the one of the multiple cameras to illuminate the track.

32. The vehicle of claim 26, wherein the plurality of viewpoints include a plan view gage side and a field side of each rail of the track.

33. The vehicle of claim 26, wherein at least one of the multiple cameras is located beneath the vehicle with a lens pointing down at the track to create a plan view image of the track.

34. The vehicle of claim 26, wherein the car includes a pair of driver operating stations at each end of the car, wherein the car can be operated in either direction from either station.

35. The vehicle of claim 26, further comprising a display terminal for the track image.

36. The vehicle of claim 26, further comprising a measuring system for automatically measuring a plurality of geometry parameters of the track and a processing system for comparing at least one of the plurality of the measured geometry parameters to at least one predetermined geometry parameters to detect the anomaly.

37. The vehicle of claim 36, wherein the measuring system measures distance travelled by the car and provides a distance marker representing distance travelled, the vehicle further comprising an interface between the measuring system and the vision system for including the distance marker in the image.

38. The vehicle of claim 26, wherein the vision system further includes a pattern recognition system operatively connected to the vision system, the pattern recognition system including a predetermined expected pattern for the image of the track and a means for ascertaining variations in the image from the predetermined expected pattern.

39. The vehicle of claim 38, wherein the pattern recognition system further includes a means for determining whether the ascertained variations in the image form the anomaly.

40. A vehicle for automatically inspecting railroad track to detect anomalies, comprising:

a car for travel on a railroad track; and a combination manual and automatic inspection system to detect the anomalies, the inspection system comprising:

a window through which the track is viewable; and a computer enhanced vision system including a camera system having a plurality of cameras arranged beneath the vehicle to create a series of overlapping fields of view that cover the entire track structure by including oblique views, said computer enhanced vision system further including imaging software receiving inputs from said cameras representative of said overlapping fields of view for creating a continuous viewable complete three dimensional image simultaneously of (1) both rails of the track including (2) an entire lateral extent of cross ties extending both between the rails and outward of both rails, (3) rail fastening elements, and (4) ballast materials and (5) at least one anomaly in (1) through (4) if present; and a video system for displaying the images of the track.

41. The vehicle of claim 40, wherein the car is self-propelled.

42. The vehicle of claim 40, further comprising a measuring system for automatically measuring a plurality of geometry parameters on the track and detecting anomalies in one or more of the plurality of parameters.

* * * * *